US005887318A

United States Patent [19]

Nicoletti

[11] Patent Number: 5,887,318

[45] Date of Patent: Mar. 30, 1999

[54] DEVICE FOR CLAMPING A TOOTHED STRAP, PARTICULARLY FOR A CLOSURE FOR SPORTS FOOTWEAR

[75] Inventor: Graziano Nicoletti, Treviso, Italy

[73] Assignee: Bauer Italia S.p.A., Treviso, Italy

[21] Appl. No.: 899,711

[22] Filed: Jul. 23, 1997

[30] Foreign Application Priority Data

Jul. 23, 1996 [IT] Italy ..... PD96A0188
Feb. 4, 1997 [IT] Italy ..... PD97A0020

[51] Int. Cl.[6] ..... A43C 11/00

[52] U.S. Cl. ..... 24/71 SK; 24/68 SK

[58] Field of Search ..... 24/68 SK, 70 SK, 24/71 SK, 69 SK, 712.1

[56] References Cited

U.S. PATENT DOCUMENTS 4,683,620 8/1987 Valsecchi et al. ..... 24/71 SK
5,172,454 12/1992 Martignago ..... 24/68 SK
5,416,952 5/1995 Dodge ..... 24/68 SK
5,606,779 3/1997 Lu ..... 24/68 SK
5,745,963 5/1998 Graziano ..... 24/68 SK

FOREIGN PATENT DOCUMENTS 0224288 6/1987 European Pat. Off. ..... 24/68 SK

*Primary Examiner*—Victor N. Sakran
*Attorney, Agent, or Firm*—Sughrue, Mion, Zinn, Macpeak & Seas, PLLC

[57] ABSTRACT

A device for clamping the toothed strap of a fastening for sports footwear comprises a base and a stop ratchet mechanism including a pawl which is articulated to the base and can engage the teeth of the strap in order to stop it, and a second-order lever articulated to the base and acting on the paw to move it away from and towards a position of engagement with the teeth of the strap.

25 Claims, 6 Drawing Sheets

DEVICE FOR CLAMPING A TOOTHED STRAP, PARTICULARLY FOR A CLOSURE FOR SPORTS FOOTWEAR

BACKGROUND OF THE INVENTION

The present invention relates in general, to a fastening designed particularly for fitting on ski-boots, snow-board-boots, skates and similar sports footwear, as well as on bindings for snow-board footwear.

SUMMARY OF THE INVENTION

In particular, the invention relates to a device for clamping the toothed strap of a fastening of the aforementioned type, comprising a base and a stop ratchet mechanism for the strap, including a pawl articulated to the base about a first axis and defining therewith a passageway for the strap, the pawl having at least one tooth which can engage the teeth of the strap in order to restrain the strap unidirectionally, and a lever articulated to the base about a second axis and acting on the pawl in order to move it away from and towards a position of engagement with the teeth of the strap.

The subject of the invention is a device of the type defined above, characterized in that the lever is a second-order lever.

The device of the invention advantageously occupies little space on the footwear, is easy for the user to manipulate, particularly during unfastening and, under load, also ensures a high degree of reliability in the clamping of the strap and hence in fastening at the desired tension.

BRIEF DESCRIPTION OF THE DRAWINGS

The characteristics and advantages of the invention will become clearer from the following detailed description of some preferred embodiments thereof illustrated, by way of non-limiting example, with reference to the appended drawings, in which.

DETAILED DESCRIPTION OF THE INVENTION

Figure 1:
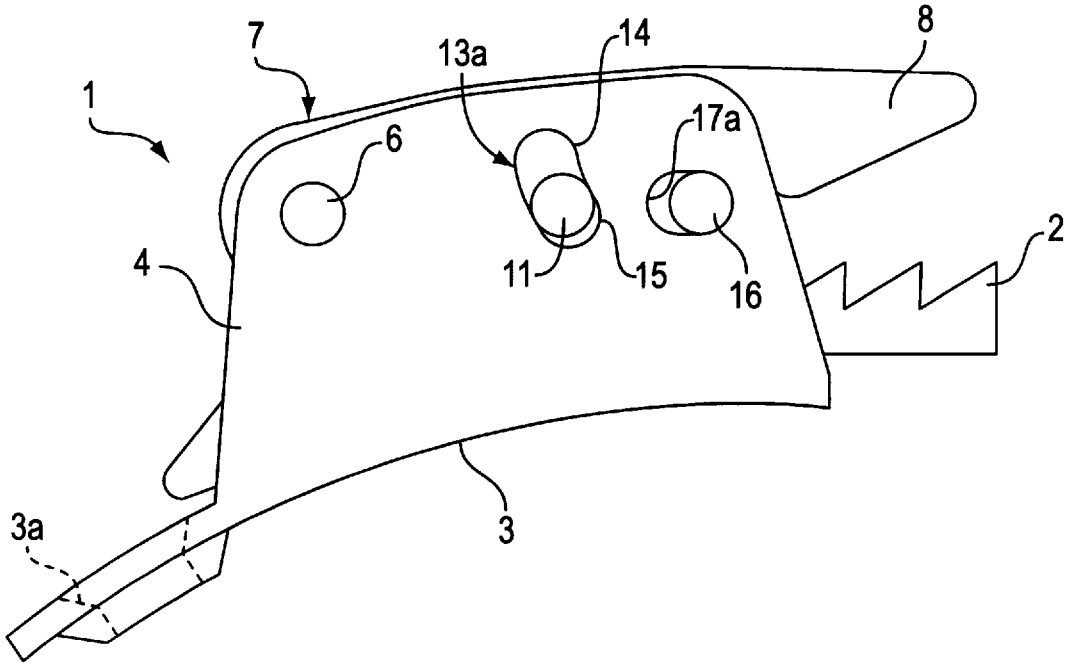
FIG. 1 is a side elevational view of a first embodiment of a device for clamping a toothed strap, formed in accordance with the present invention.
Figure 2:
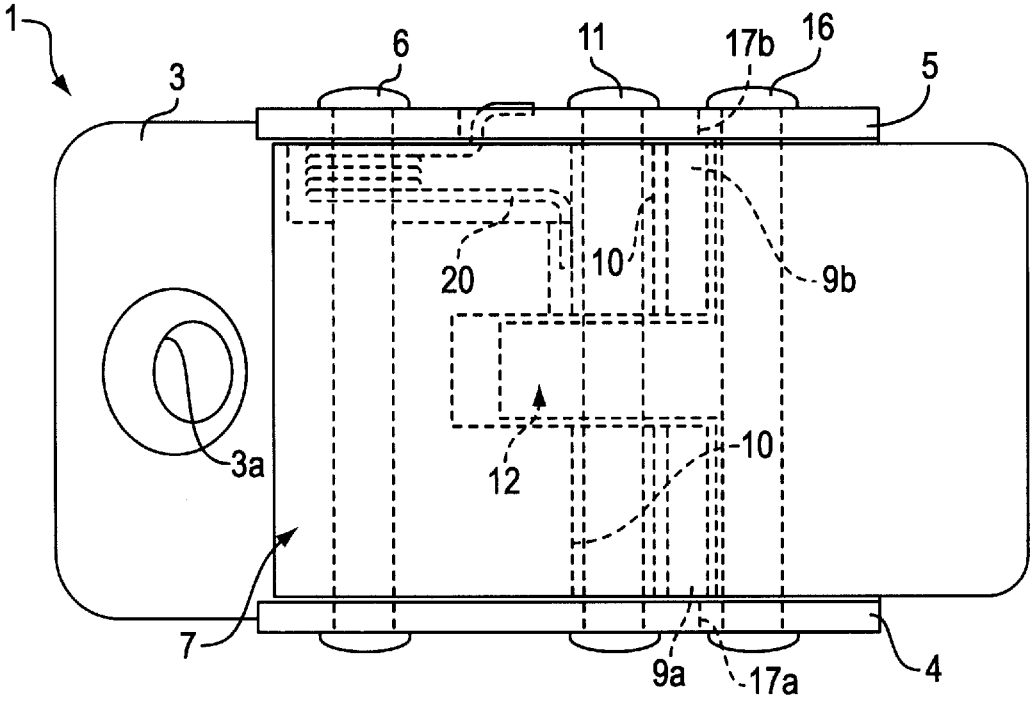
FIG. 2 is a plan view of the device of FIG. 1, FIGS. 3 and 4 are longitudinal sections of the device of FIG. 1 in two different operative conditions.

With reference to FIGS. 1 to 4, a first embodiment of a device for clamping a toothed strap 2 or rack of a fastening for ski-boots, skates and similar sports footwear, generally of the type having a moulded plastics upper, is generally indicated 1. The device is also suitable for mounting on fastenings provided in bindings for snow-board boots.

The device 1 comprises a base 3 with shoulders 4 and 5 on opposite sides and is intended to be fixed to a flap of the upper by means, not shown, for example, by one or more rivets which engage holes 3*a* formed in the base 3.

A first pin 6 is fixed to the shoulders 4, 5 and one end 7*a* of a lever 7 bearing an operating appendage 8 at its opposite end, is articulated on the pin 6.

Two identical and parallel appendages 9*a*, 9*b* extend in the same direction from the lever 7 and a hole 10 extends through both appendages. The hole 10 houses, with radial clearance, a second pin 11 on which a pawl, indicated 12 is articulated.

The lever 7 and the pawl 12 are therefore articulated to one another by means of the pin 11 with an articulation axis disposed between the axis of the pin 6 and the operating appendage 8 so that the lever 7 acts on the pawl 12 like a second-order lever.

The pin 11 is also engaged for sliding in slots 13*a*, 13*b* formed in the opposed shoulders 4, 5 of the base 3, respectively.

Each slot 13*a*, 13*b* comprises a first and a second portion, indicated 14, 15, respectively, one forming an extension of the other. The first portion 14 is substantially straight or curved but in any case allows the lever 7 to pivot freely about the axis of the first pin 6.

The second portion 15 is oriented away from the first pin 6 to form a kind of recess for housing the second pin 11, as will be explained further below.

The pawl 12 is also articulated to the base 3 by means of a third pin 16 disposed on the opposite side of the pin 11 to the pin 6. The pin 16 is housed for sliding and rotating in a second slot 17*a*, 17*b* formed in the respective shoulder 4, 5.

Owing to this engagement, the pawl 12 is pivotable on the base 3 with a movable fulcrum (pin 16—slot 17*a*, 17*b*).

A passageway P is defined for the strap 2 between the pawl 12 and the base 3.

The pawl 12 also has a pair of teeth 19 in its wall facing towards the base 3 for engaging homologous teeth of the strap 2 so as to constitute stop ratchets for the strap.

The lever 7 and the pawl 12 therefore constitute a "stop ratchet mechanism" for the toothed strap 2, as will become clear from the following description.

The pawl 12 is acted on by a spring 20 wound on the first pin 6 and having one end restrained on one of the shoulders 4, 5 and the other end bearing against a surface 21 of the pawl. Since the pawl 12 and the lever 7 are articulated to one another, the spring 20 acts on the lever via the pawl.

The device 1 operates as follows. In an initial condition of the device (FIG. 3), the toothed strap 2 is inserted through the passageway P defined by the lever 7, by the base 3 and by the respective shoulders 4, 5.

As the strap 2 passes through the passageway, its forward movement is not obstructed by the pawl 12, although the pawl 12 interferes with the teeth of the strap 2. In fact, since the pawl 12 is free to move angularly about the pin 16 (clockwise) the stop ratchets 19 "skip" over tooth after tooth as long as this forward movement continues, that is, until the desired displacement of the strap relative to the base 3 has been achieved.

When it has passed beyond the base 3, the strap 2 is pulled manually by the user or is tensioned by means of suitable conventional tensioning devices until the desired degree of tensioning is reached.

Figure 4:
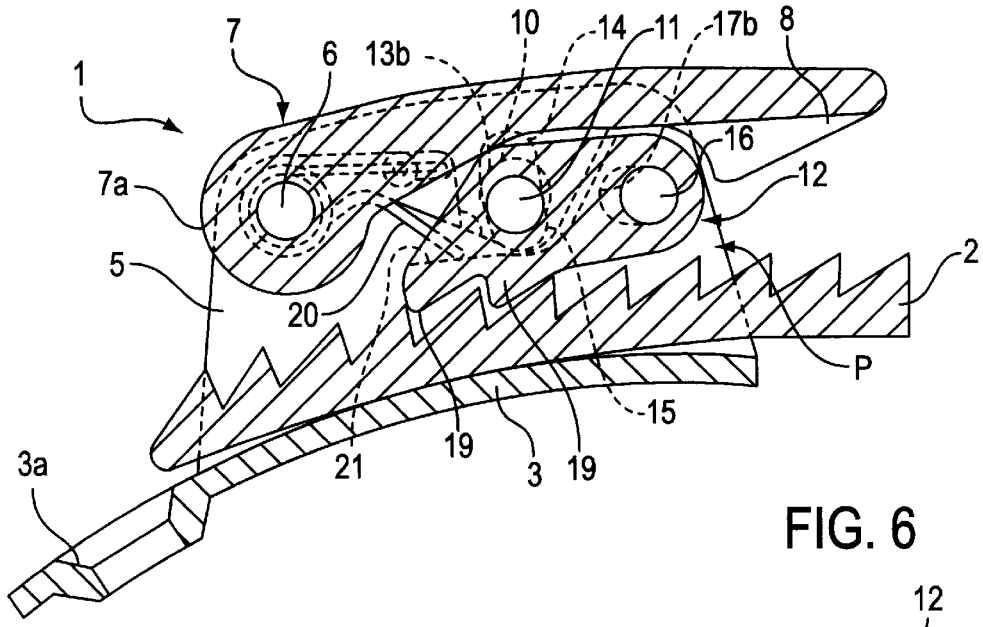
Figure 6:
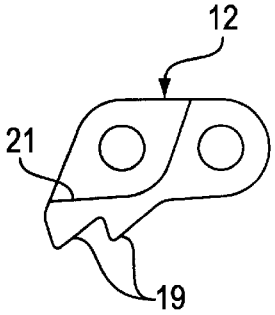
FIGS. 5 and 6 are side elevational views showing some details of the device of the preceding drawings, on a reduced scale.
Figure 5:
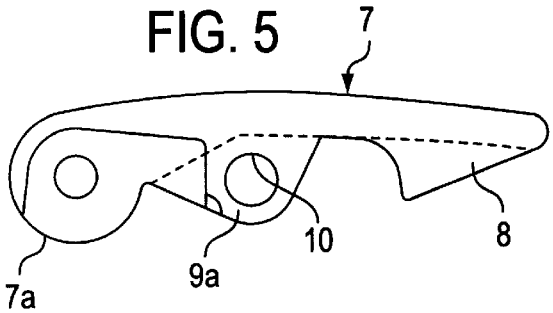

When this tensioning has been reached, the stop ratchets 19 engage the teeth of the strap 2 positively, clamping it in the position reached (FIG. 4).

It should be noted that, in the position of FIG. 4 in which the strap 2 clamped, owing to the load exerted on the teeth 19 by the strap 2 under tension, the pawl 12 is displaced towards the right (as seen in FIG. 4) with the third pin 16 in abutment with the corresponding end of the slot 17*a,* 17*b*. The second pin 11 is consequently housed in the recess 15 of the corresponding slot 13*a,* 13*b*, thus preventing pivoting of the pawl 12 about the axis of the pin 16 and consequent disengagement of the teeth 19 from the teeth of the strap 2.

To open the device, enabling the strap to be withdrawn from the passageway 18 and thus enabling the footwear to be "unfastened", it suffices to move the lever 7 angularly about the respective first pin 6 in order to move the stop ratchet mechanism away from the base 3.

Upon a first operation of the lever 7 (anticlockwise with reference to FIG. 4) the pins 11 and 16 are guided along a rotational-translational path by the second portions 15 of the slots 13*a,* 13*b* and by the slot 17*a,* 17*b*. Upon passing over the connection point between the first and second portions 14, 15 of the slots 13*a,* 13*b,* the pin 11 is guided by the first slot portion 14 causing pivoting of the lever 7 about the axis of the pin 6 (anticlockwise) and of the pawl about the axis of the pin 16 (clockwise).

Figure 3:
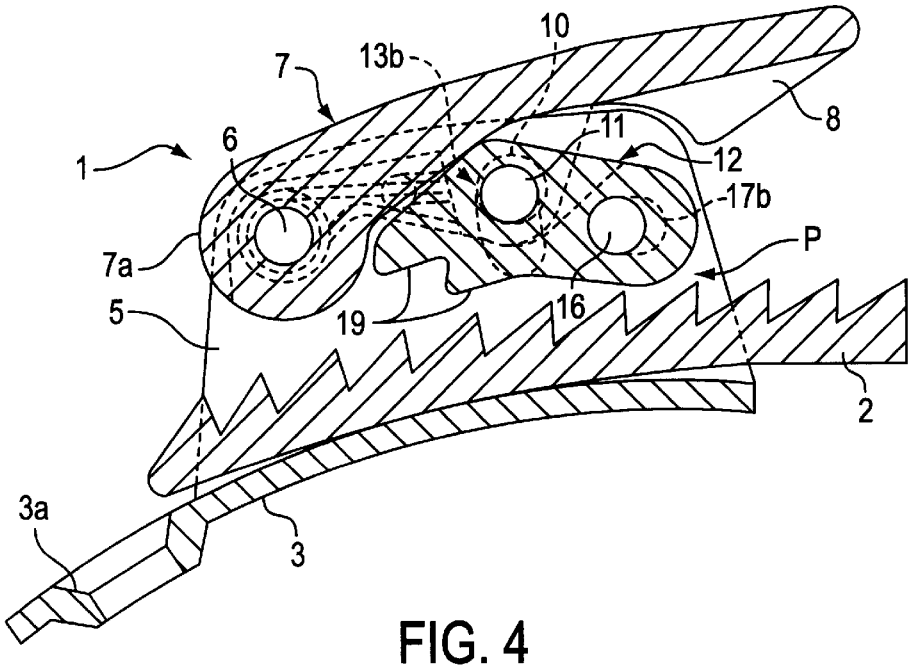

The pin 16 is kept close to the end of the slot 17*a,* 17*b* nearest the slot 13*a,* 13*b* (left-hand abutment). As a result of these angular movements of the lever 7 and of the pawl 12, the teeth 19 are completely disengaged from the teeth of the strap 2 (FIG. 3).

It should be noted that, by virtue of the radial clearance between the hole 10 and the pin 11, the latter can be moved along the slots 13*a,* 13*b* by means of the lever 7, on a rotational-translational path relative to the axis of the articulation of the lever to the base.

Moreover, it should be noted that the shapes and arrangement selected for the slots 13*a,* 13*b* and 17*a,* 17*b* are such that, at least for a portion of the angular movement of the lever 7, the pawl 12 is guided on a purely rotational path so as advantageously to reduce the frictional forces which, particularly in the presence of mud or earth on the fastening, may compromise the correct operation of the device.

With reference to FIGS. 7 to 12, a second embodiment of a device for clamping the toothed strap 2 of a fastening according to the present invention is generally indicated 100, details similar to those of the previous embodiment being indicated by the same reference numerals. The device 100 comprises a base 3 which has shoulders 4, 5 on opposite sides and is intended to be fixed to one of the flaps or portions to be fastened by means, not shown, for example, by one or more rivets which engage holes 3*a* formed in the base 3.

A first pin 6 is fixed to the shoulders 4, 5, and a first end 107*a* of a lever 107 bearing an operating appendage 108 at its opposite end, is articulated thereon.

Two identical and parallel appendages 109*a,* 109*b,* extend in the same direction from the lever 107, a respective third slot 110 extending through each appendage.

Figure 8:
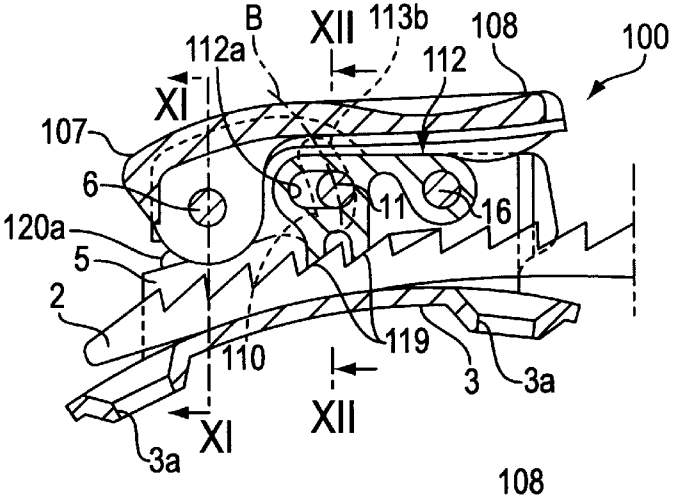
FIGS. 8, 9 and 10 are longitudinal sections of the device of FIG. 7 in three different operating conditions.
Figure 7:
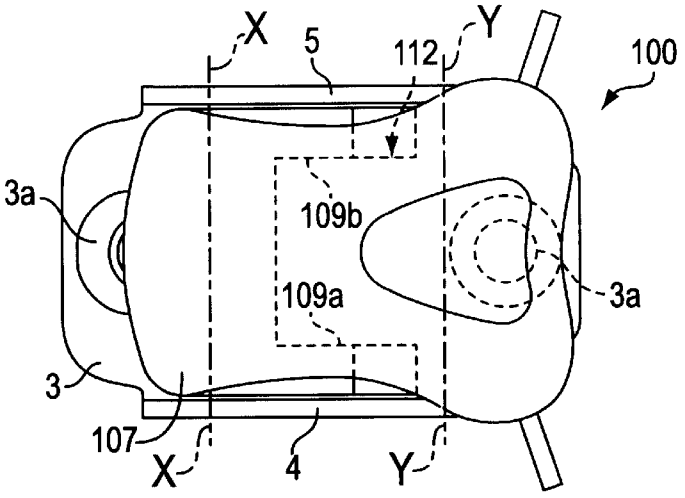
FIG. 7 is a plan view of a second embodiment of the device according to the present invention.

The slots 110 are elongate in the same direction as an arc indicated B in FIG. 8 and centred on the axis X.

The slot 110 is preferably straight and elongate in a direction substantially tangential to the arc B.

A second pin 11 is housed for sliding in the slots 110 and a pawl, indicated 112, is articulated thereon.

More particularly, the second pin 11 is housed in a fourth slot 112*a* which extends through the pawl 112 and is elongate along an axis intersecting the longitudinal axis of the slot 110 (FIG. 8).

The lever 107 and the pawl 112 are therefore articulated to one another by means of the pin 11, with an articulation axis disposed between the axis X and the operating appendage 108 so that the lever 107 acts on the pawl like a second-order lever.

The pin 11 is also engaged for sliding in fifth slots 113*a,* 113*b* formed, respectively, in the opposed shoulders 4, 5 of the base 3.

The pawl 112 is also articulated to the base 3 by means of a third pin 116 having an axis Y disposed on the opposite side of the pin 11 to the pin 6.

The fourth slot 112*a* is elongate radially relative to the axis Y, whereas the fifth slots 113*a,* 113*b* are elongate in the same direction as the third slot 110.

The passageway P for the toothed strap 2 is defined between the pawl 112 and the base 3.

The pawl 112 also has a pair of teeth 119 in its wall facing towards the base 3 for engaging homologous teeth of the strap 2 so as to constitute, together with the lever 107 a "stop ratchet mechanism" for the strap.

The lever 107 is acted on by a spring 120*a* wound on the first pin 6 and has one end restrained on one of the shoulders 4,5 and the other end restrained on the lever 107. Since the lever 107 and the pawl 112 are articulated to one another, the spring 120*a* acts on the pawl by means of the lever.

The device 100 operates as follows. In an initial condition of the device (FIG. 8) the toothed strap 2 is inserted through the passageway P. As the strap 2 passes through the passageway, its forward movement is not obstructed by the pawl 112 although the pawl 12 interferes with the teeth of the strap 2. In fact, since the pawl 112 is free to move angularly about the pin 16 (clockwise as seen in FIG. 8) the stop teeth 119 "skip" over tooth after tooth as long as this forward movement continues, that is, until the desired displacement of the strap relative to the base 3 has been achieved.

When it has passed beyond the base 3, the strap 2 is pulled manually by the user until the desired degree of tensioning is reached.

When this tensioning has been reached, the stop teeth engage the teeth of the strap 2 positively, clamping it in the position reached, shown in FIG. 8.

In this position, the slots 110, 112*a* are arranged with their longitudinal axes substantially perpendicular to one another, as shown in FIG. 8. In this position in which the strap 2 is clamped, owing to the load exerted on the teeth 119 by the strap under tension, the pawl 112 is urged towards the right (as seen in FIG. 8) into abutment with the corresponding pin 16 whilst, owing to the arrangement of the slot 112*a*, the second pin 11 is urged by the pawl 112 towards the base 3 so as to remain in abutment with the corresponding ends of the slots 113*a,* 113*b* of the base and thus to prevent pivoting of the pawl 112 about the axis of the pin 16 and consequent disengagement of the teeth 119 from the strap 2.

Moreover, in this clamping position, by virtue of the arrangement of the slot 112*a*, the lever 107 is not stressed, via the second pin 11, by the tensioning force applied in the fastening.

To open the device to enable the strap to be withdrawn from the passageway P and hence to enable the footwear to be "unfastened", it suffices to move the lever 107 angularly about the respective first pin 6 in order to move the pawl 112 away from the base 3.

Figure 10:
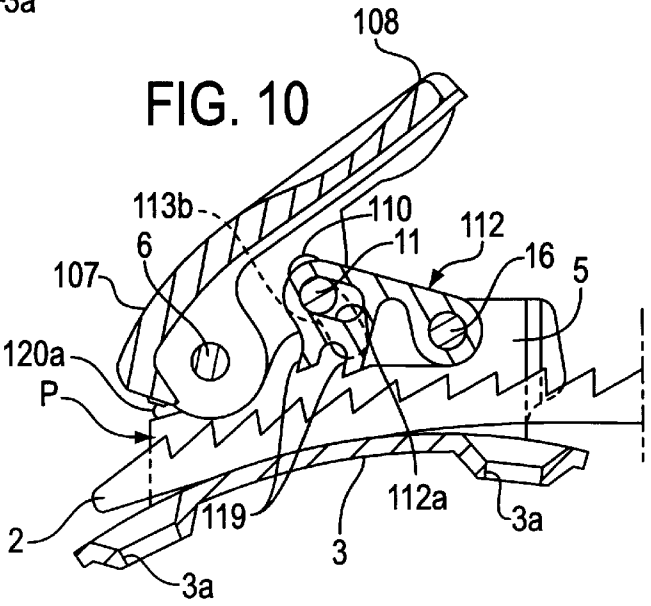
Figure 9:
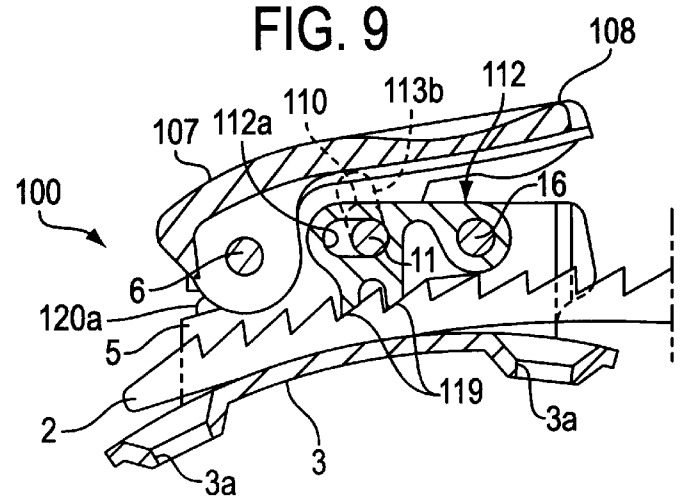
Figure 12:
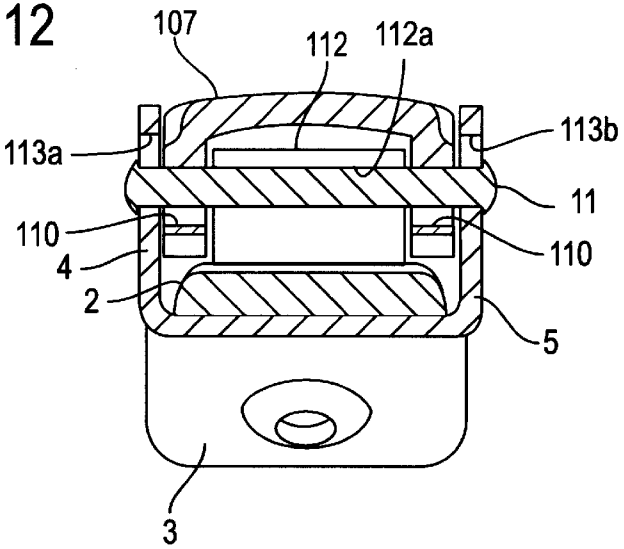
FIGS. 11 and 12 are sections taken on the lines XI—XI and XII—XII of FIG. 8, respectively.
Figure 13:
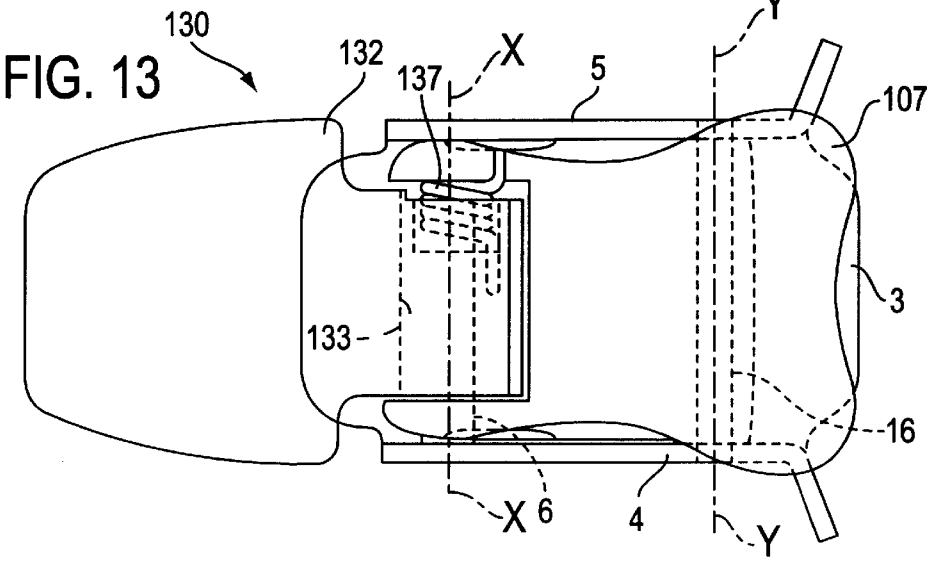
FIG. 13 is a plan view of a third embodiment of the invention.
Figure 11:
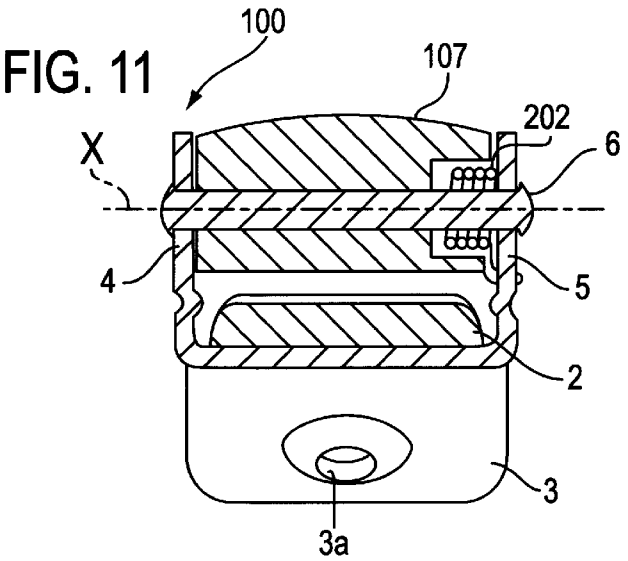

Upon a first pivoting operation of the lever 107 (anticlockwise with reference to FIG. 9) the third slot 110 slides relative to the pin 11 and the pin 11 is not acted on by the lever 107 until it is in abutment with the corresponding end of the slot 110 in the position shown in FIG. 9. When this operative condition has been passed, upon a further pivoting of the lever (anticlockwise with reference to FIG. 9) the pin 11 is guided by the slots 113*a,* 113*b* along a path which, by virtue of the arrangement of the slots 110 and 112*a*, is a rotational path about the axis X of the first pin 6 and a rotational-translational path about the axis Y of the third pin 16 with consequent pivoting of the pawl 112 about the axis of the pin 16 (clockwise in FIG. 10). The second pin 11 is kept close to the end of the slot 113*a,* 113*b* farthest from the base 3 and, as a result of these angular movements of the lever and of the pawl, the teeth 119 are completely disengaged from the teeth of the strap 2 (FIG. 10).

It will be noted that the shapes and arrangement selected for the slots 110 and 113*a,* 113*b* are such that the angular movement of the lever 107 is substantially equal to the sum of the angular movements permitted by the lengths of the slots 110 and 113*a,* 113*b*.

It should also be noted that, during the angular movement from the position of FIG. 8 in which the pawl 112 is clamped onto the strap to the partially pivoted position of FIG. 9, the lever 107 is not acted on by the clamping force applied between the pawl and the strap. As a result, the pawl is completely disengaged from the strap by an angular movement of the lever at least part of which requires no effort by the user except for that required to lift the lever 107 itself.

With reference to FIGS. 13 to 16, it is envisaged that the clamping device 100 of the previous embodiment may be associated with a second lever 132 provided for advancing the strap 2 through the passageway P in a fastening generally indicated 130.

For a description of the clamping device, reference should be made to the previous embodiment, upon the understanding that parts corresponding to this embodiment are indicated by the same reference numerals.

The second lever 132 is mounted for pivoting on the first pin 6 about the axis X of the articulation of the lever 107 to the base 3 by means of a slot 133 extending through the lever 132 close to one of its ends. The opposite end of the second lever 132 extends outside the base 3 and constitutes an operating end or grip 134 of the lever.

At the opposite end to the grip 134, the lever 132 defines an integral pawl 135 with three teeth 136*a,* 136*b,* 136*c* which can engage the teeth of the strap 2.

A spring 137 wound on the first pin 6 has one end restrained on one of the arms 107*a,* 107*b* of the lever 107 and the other end bearing under the appendage constituting the tooth 136*c* of the pawl 135.

The second lever 132 and the respective second pawl 135 therefore constitute a ratchet mechanism for advancing the strap 2, as will become clear from the following description.

In operation, the strap 2 is inserted through the passageway P as described in the previous embodiment.

Figure 14:
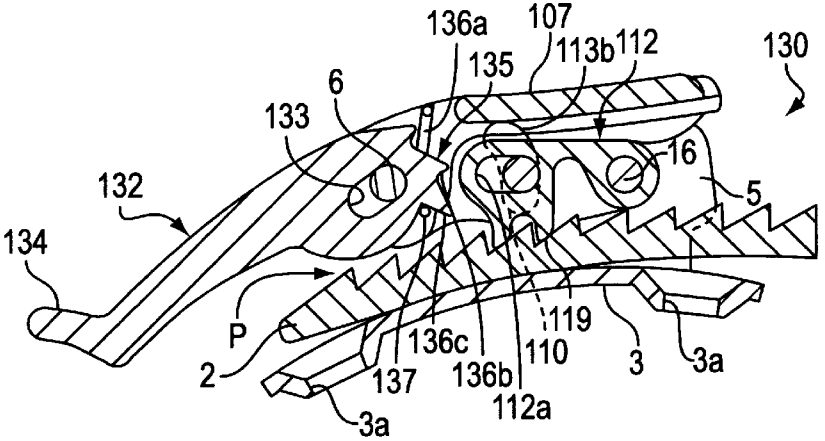
Figure 15:
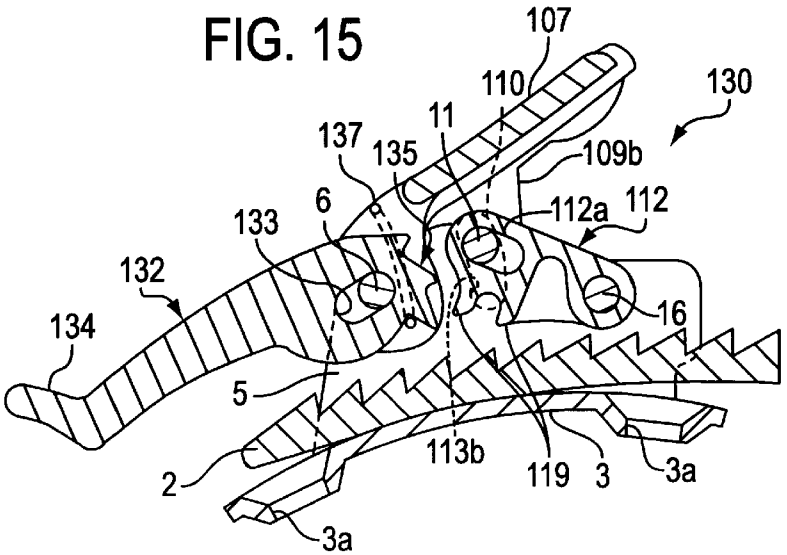
Figure 18:
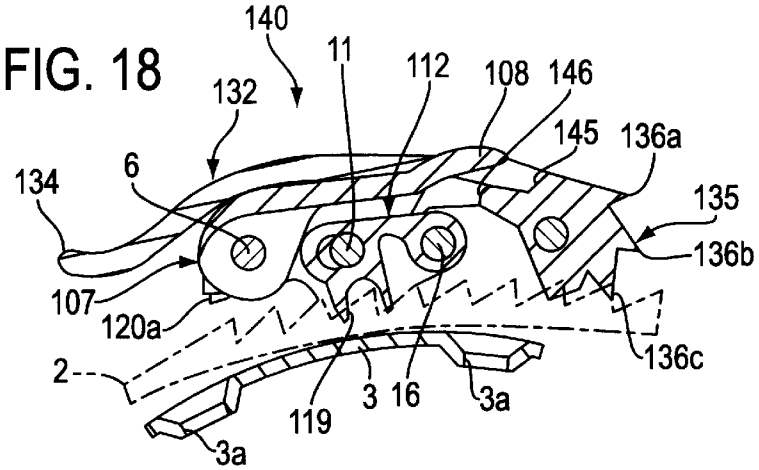

When it has passed beyond the base 3, the strap is gripped manually by the user and "pulled" as far as possible so as to achieve so-called rough tensioning. At this point, the user can carry out a fine adjustment of the desired degree of tensioning, under load, by the operation of the second lever 132. For this purpose, the second lever 132 is pivoted about the pin 6 (clockwise as seen in FIG. 14) so as initially to engage the second pawl 135 between the teeth of the strap 2 (FIG. 16) and, subsequently, upon completion of the aforementioned angular movement, to advance the strap through the passageway P. As described above, this forward movement is not obstructed by the stop ratchet mechanism, the teeth 119 of which skip over tooth after tooth as long as this forward movement continues, that is, until the maximum angular movement of the lever 132 has been completed (FIG. 16).

Figure 16:
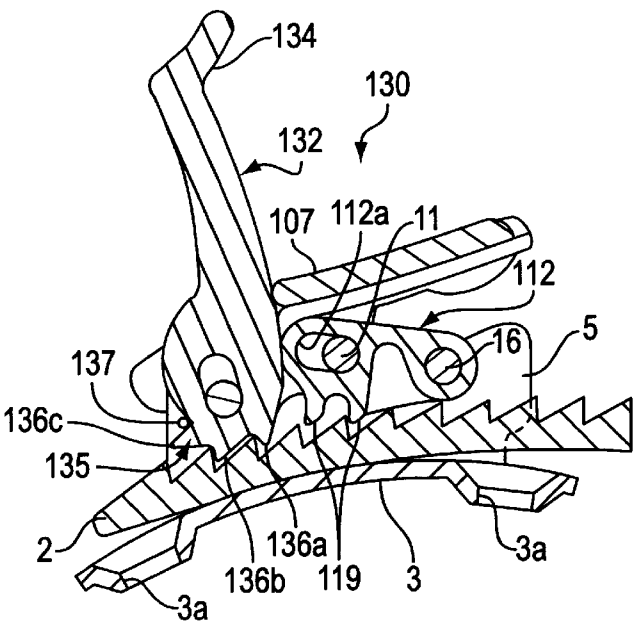
FIGS. 14 to 16 are longitudinal sections of the device of FIG. 13 in three different operative conditions.

When the maximum possible angular movement has been achieved the lever 132 is lowered (anticlockwise as seen in FIG. 16) and, by virtue of the provision of the slot 133 which extends in the same direction as the pawl 135, the teeth 136*a,* 136*b,* 136*c* of the latter can be disengaged from the strap as a result of the relative movement between the pin 6 and the lever 132 permitted by the length of the slot 133. During this angular movement of the lever 132, the teeth 119 of the stop ratchet mechanism positively engage the teeth of the strap 2, clamping the latter in the position reached.

The desired degree of tensioning is reached by a number of angular movements of the lever 132 such as that described above. When fastening has been completed, the lever 132 is urged by the spring 137 to the position shown in FIG. 14 in which the pin 6 is urged against the end of the slot closest to the pawl 135.

To open the fastening 130, it suffices to move the lever 107 angularly about its fulcrum on the base exactly as described in the previous embodiment.

With reference to FIGS. 17 to 20, a device structurally and functionally equivalent to that described in the previous embodiments is associated with a fastening, generally indicated 140. The fastening 140 differs from that of the previous embodiment in that the lever 132 is articulated on the base 3 by means of a pair of links 143*a,* 143*b*. More particularly, the second lever 132 is articulated, by means of a pin 142, to corresponding ends of the links 143*a,* 143*b* the opposite ends of which are articulated about the axis Y of the pin 16.

A spring 144 wound on the pin 142 acts between each link, 143*a,* 143*b* and the lever 132.

A through hole 145 is formed in the second lever 132 and is affected by an appendage 146 of the lever 132.

Figure 20:
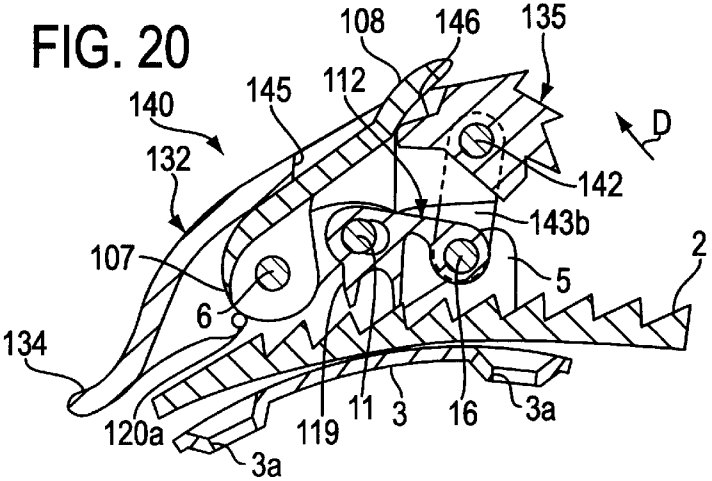
Figure 17:
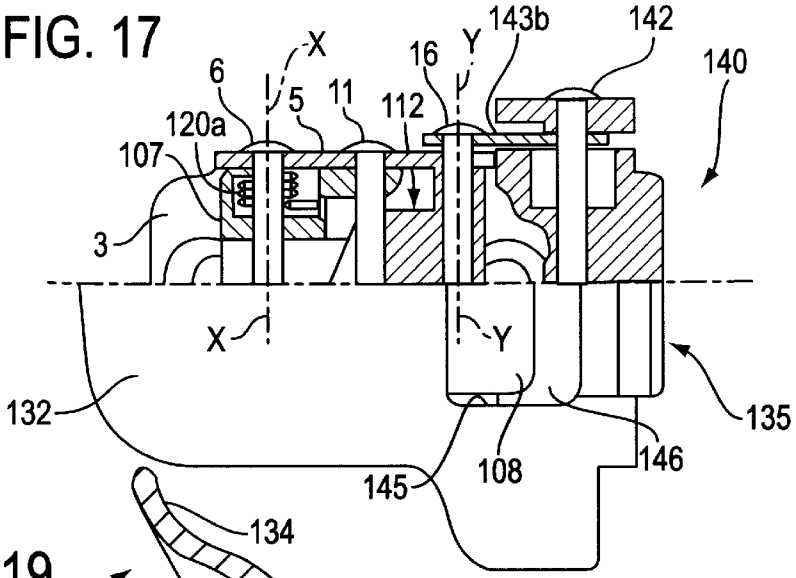
FIG. 17 is a partially-sectioned plan view of a fourth embodiment the invention, FIGS. 18, 19 and 20 longitudinal sections of the device of FIG. 17 in three different operative conditions.

The free end of the operating appendage 108 of the lever 107 of the stop ratchet mechanism extends through the hole 145, projecting therefrom above the appendage 146 so as to interfere with the appendage 146 as a result of a pivoting movement of the second lever 132 in the direction of disengagement of the second pawl 135 from the strap 2 (FIG. 20).

Figure 19:
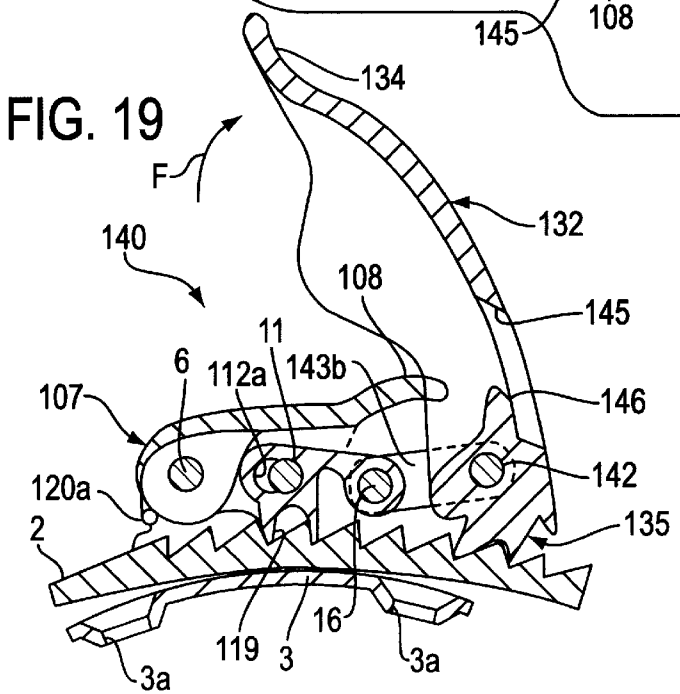

In operation, the degree of tensioning is adjusted by pivoting the lever 132 in the direction indicated by the arrow F of FIG. 19 so as to engage the pawl 135 with the teeth of the strap 2 and consequently to advance the strap through the passageway P. When the desired degree of tensioning has been reached, the lever 132 is lowered to the position of FIG. 18 in which the stop teeth 119 positively engage the teeth of the strap 2, clamping it in the position reached. To open the fastening 140, the lever 132 is pivoted away from the strap 2 in the direction indicated by the arrow D of FIG. 20, for example, by pressure exerted on the free end of the grip 134 of the lever 132. As a result of this pivoting, by virtue of the interference between the appendage 146 and the operating appendage 108 of the lever 107, the latter is moved angularly about the pin 6 (anticlockwise as seen in FIG. 20) and the pawl 112 is consequently pivoted (clockwise) so as to be disengaged from the teeth of the strap 2.

The invention thus devised may undergo variations and modifications all falling within the scope of the invention concept as defined by the following claims.

What is claimed is:

1. A device for clamping a toothed strap of a fastening for sports footwear, comprising a base and a stop ratchet mechanism for the strap, including:

a pawl articulated to the base about a first axis and defining therewith a passageway for the strap, the pawl having at least one tooth which can engage the teeth of the strap in order to restrain the strap unidirectionally, and a lever articulated to the base about a second axis and acting on the pawl in order to move it away from and towards a position of engagement with the teeth of the strap, characterized in that the lever is a second-order lever.

2. A device according to claim 1, in which the lever and the pawl are articulated to one another.

3. A device according to claim 2, in which the lever is articulated to the pawl with a limited capacity for relative rotation/translation.

4. A device according to claim 3, in which the lever is articulated to the pawl with radial clearance.

5. A device according to claim 1, in which a spring means is provided, acting between the pawl and the base in order to urge the pawl towards the position of engagement with the teeth of the strap.

6. A device according to claim 5, in which the lever is restrained on the pawl so that the resilient means acting on the pawl also acts on the lever.

7. A device according to claim 1, in which the pawl is articulated to the base so as to be rotatable/translatable relative thereto.

8. A device according to claim 1, in which the stop ratchet mechanism comprises a first pin by which the lever is articulated to the base, a first slot for housing a second pin by which the pawl is articulated to the lever, and a second slot for housing a third pin by which the pawl is articulated by one of its ends to the base.

9. A device according to claim 8, in which the first slot includes a first and a second portion, the first portion extending along the path of the second pin during the pivoting of the lever about the first pin, the second portion extending to define a recess for housing the second pin in order to oppose the pivoting of the lever about the first pin when the stop ratchet mechanism is under load.

10. A device according to claim 9, in which the second portion of the first slot extends away from the first pin.

11. A device according to claim 1, in which the pawl is articulated to the lever in a position disposed between the fulcrum of the lever on the base and an operating appendage of the lever.

12. A device according to claim 1, in which the lever is articulated to the pawl in a position disposed between the fulcrum of the pawl on the base and an end of the pawl constituting a stop ratchet for the strap.

13. A device according to claim 1, in which the second-order lever has its fulcrum on the second axis and is restrained on the pawl in a position between the said axes by means of at least one third slot and a corresponding pin extending through the slot, the slot being formed on one or other of the lever and the pawl and being elongate in the same direction as an arc centred on the fulcrum of the lever.

14. A device according to claim 13, in which a fourth slot is formed in the other of the lever and the pawl and is elongate along an axis intersecting the third slot, the pin extending through the third and fourth slots.

15. A device according to claim 14, in which the base has at least one fifth slot through which the pin extends and which is elongate in the same direction as the third slot.

16. A device according to claim 1, in which a spring means is provided, acting between the lever and the base.

17. A device according to claim 1, comprising a second lever connected for pivoting on the base and bearing at least one second pawl which can engage the teeth of the strap in order to advance it as a result of the pivoting of the second lever.

18. A device according to claim 17, in which the second lever is articulated on the base about the second axis.

19. A device according to claim 18, in which the second lever is articulated on the base by means of a slot elongate in the same direction as the second pawl.

20. A device according to claim 18, in which the second pawl is integral with the second lever.

21. A device according to claim 17, in which the second lever is articulated to a corresponding end of a pair of links the opposite end of which is articulated to the base about the first axis.

22. A device according to claim 21, in which a second spring means is provided, acting between the second lever and the links.

23. A device according to claim 21, in which the second lever comprises an appendage which acts on the lever of the stop ratchet mechanism in order to pivot it in the direction of disengagement of the stop pawl as a result of the pivoting of the second lever in the direction of disengagement of the second pawl from the strap.

24. A device according to claim 23, in which a hole at least partially affected by the appendage is formed in the second lever, the lever of the stop ratchet mechanism extending through the hole so as to interfere with the appendage as a result of the pivoting of the second lever in the direction of disengagement of the second pawl from the strap.

25. A fastening for ski boots and similar sports footwear, comprising a toothed strap and a device for clamping the strap according to claim 1.

* * * * *